9/29/81 XR 4,291,772

United States Patent [19]

Beynet

[11] 4,291,772

[45] Sep. 29, 1981

[54] DRILLING FLUID BYPASS FOR MARINE RISER

[75] Inventor: Pierre A. Beynet, Tulsa, Okla.

[73] Assignee: Standard Oil Company (Indiana), Chicago, Ill.

[21] Appl. No.: 133,703

[22] Filed: Mar. 25, 1980

[51] Int. Cl.[3] ..... E21B 7/12; E21B 17/01; E21B 21/08

[52] U.S. Cl. ..... 175/5; 175/7; 175/38; 175/40; 175/25

[58] Field of Search ..... 175/7, 10, 5, 38, 48, 175/50, 40, 25; 166/335, 358, 367, 359

[56] References Cited

U.S. PATENT DOCUMENTS

| | | | |
|---|---|---|---|
| 3,465,817 | 9/1969 | Vincent | 166/367 |
| 3,601,187 | 8/1971 | Tidwell | 175/7 X |
| 3,791,442 | 2/1974 | Watkins | 166/359 |
| 3,815,673 | 6/1974 | Bruce et al. | 166/359 |
| 3,825,065 | 7/1974 | Lloyd et al. | 175/7 X |
| 4,063,602 | 12/1977 | Howell et al. | 175/7 |
| 4,091,881 | 5/1978 | Maus | 175/7 |
| 4,099,583 | 7/1978 | Maus | 175/7 |
| 4,149,603 | 4/1979 | Arnold | 175/7 |

*Primary Examiner*—Stephen J. Novosad
*Attorney, Agent, or Firm*—John D. Gassett

[57] ABSTRACT

Method and apparatus are described to reduce the tension required on a riser pipe used in offshore drilling between a floating vessel and a subsea wellhead. Heavy drilling fluid is circulated down a drill pipe and up the annulus between the drill pipe and the borehole wall to a point just above a subsea wellhead. From this point, a separate drilling fluid return conduit extends to the floating vessel. Means are provided to maintain a constant level of an interface between the heavy returning drilling fluid and the lightweight fluid which can be confined within the riser pipe.

18 Claims, 2 Drawing Figures

DRILLING FLUID BYPASS FOR MARINE RISER

This invention concerns the drilling of wells, particularly oil and gas, from a floating vessel. The most common method of drilling from floating vessels is by the use of a riser pipe which is a large diameter steel pipe, e.g., 20 inches, which extends from the floating vessel to a wellhead on the sea floor. The lower end is releasably connected to the wellhead by disconnect connectors which are commercially available, and the upper end is supported from the vessel by constant tensioning devices. As wells are drilled in deeper water it, of course, requires a longer riser pipe. When using a riser pipe in normal operations, a drilling fluid is circulated down a drill string through a drill bit and back up the annulus between the drill string and the borehole wall up through the annulus between the riser and the drill string.

When a drilling vessel drills in deep water and is using heavy mud, the marine riser has to be kept under very high tension to keep it from buckling. This tension supports the weight of the riser and the weight of the mud inside the riser. The weight of the mud inside the riser pipe is normally greater than the weight of the riser pipe itself. I disclose a system and method for greatly reducing the weight of the drilling mud within the riser pipe. A seal is provided at the top of the riser. The seal is of the type that permits the drill pipe to rotate and advance downwardly through it when it is not energized. I next provide a mud return conduit from the bottom interior of the riser pipe to the vessel. Above the drilling mud and in most of the riser pipe is a low-density fluid. Sufficient pressure is provided on this low-density fluid to prevent the drilling mud from rising substantially in the riser pipe. A pump is provided in the mud return conduit to pump the mud through the conduit to the vessel instead of up through the riser pipe, as is normally done. This permits the use of the required heavy or high-density drilling fluid, yet keeps the high-density drilling fluid from the riser pipe so that the tensioning on the riser pipe is much less than is normally the case.

Control means for the pump is provided and is responsive to the interface between the drilling fluid and the lightweight fluid in the riser annulus. This assists in maintaining the interface at a desired level. As will be explained hereinafter, by the use of the method described herein, I reduce the chances of fracturing a shallower formation when a heavy mud is required to control the well when drilling at a deeper depth.

A better understanding of the invention can be had from the following description taken in conjunction with the drawings.

DRAWINGS

DETAILED DESCRIPTION OF THE INVENTION

Figure 1:
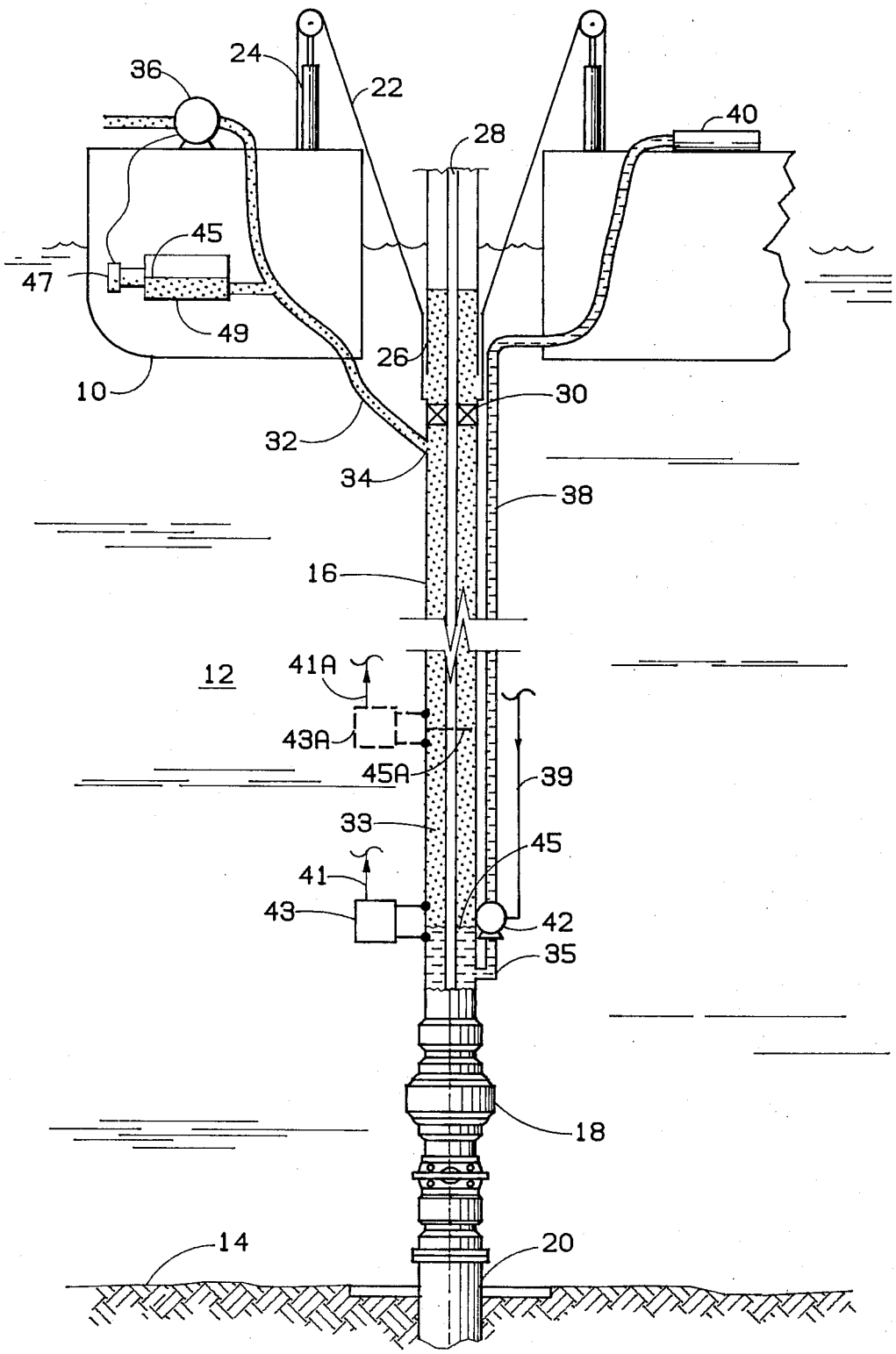
FIG. 1 illustrates a drilling system using a riser pipe supported from a floating vessel to drill a subsea well in which the riser pipe is filled with a low-density fluid.

Shown in FIG. 1 is a drilling vessel 10 floating on a body of water 12 with a bottom 14. A riser pipe 16 connects the vessel to a subsea wellhead 18 which is provided with blowout preventers and other necessary valves and is mounted on a casing 20 which extends into the seafloor 14. The upper end of the riser pipe is supported from the drilling vessel by cables or lines 22 connected to constant tensioning devices 24 in a known manner. A slip joint 26 is provided in the riser pipe 16 in its upper end and a drill string 28 is supported within the riser pipe from a derrick, not shown, on drilling vessel 10.

A seal 30 is provided in the upper end of riser pipe 16. Seal 30 can be a Hydril Bag Type BOP such as Type GL or GK shown in the 1978-79 Composite Catalog, Pages 36–40. To decrease the wear on seal 30, an optimal section or joint of polished drill pipe can be threaded into the drill string just below the kelley and kept in that position during the drilling of the well. A light-weight fluid conduit 32 is connected at point 34 to the interior of the riser pipe 16 and extends to a pump 36 and a supply of lightweight fluid not shown. A return mud flow line 38 connects into the annulus of the riser pipe 16 just above wellhead 18 and extends to mud return tanks and facilities 40 which are carried by vessel 10. The return mud line can be one of the "kill and choke" lines with appropriate bypass valving for the pump. A mud return pump 42 is provided in the lower end of mud return conduit 38.

In FIG. 1, the mud return pump 42 can be controlled by a level control means 43 to sense and control the interface 45 between the lightweight fluid 33 and the heavy drilling mud 35. This prevents a full head of heavy drilling fluid in conduit 38 from being applied to the drilling mud at depth. There can be a series of level control means 43, 43A along the riser pipe with output lines 41, 41A going to the surface where one can select which level 45, 45A, etc., is needed to obtain the desired pressure gradient. The output from the selected level control is used to send a control signal down line 39 to pump 42. The lightweight fluid upper level 45 is controlled by a level sensor 47 with a suitable circuit to average the heave effect. Level 45 is detected in container 49 which is connected to line 32. In the case where the lightweight fluid is a gas, it is controlled by a pressure regulator instead of level sensor 47. The output of liquid level control sensor 47 or of the pressure regular controls pump 36 so as to maintain a constant level 45 or selected pressure.

The lightweight fluid can be sea water, which weighs approximately 8.6 lbs/gal or it may be nitrogen gas. The heavy mud which it replaced may weigh as much as 18 lbs/gal or more. Without my system, the tension needed to be applied to riser 16 from the vessel 10 would typically be 400,000 lbs. With my system, using a lightweight fluid such as sea water, the tension which needs to be applied is only 200,000 lbs. This example is for a 16" riser with flotation, in 1260' of water, an 18 lbs/gal drilling fluid, 50 foot of vessel offset, 1 ft/sec current, 25 ft, 11-second waves, and maximum lower ball angle of 4°.

Figure 2:
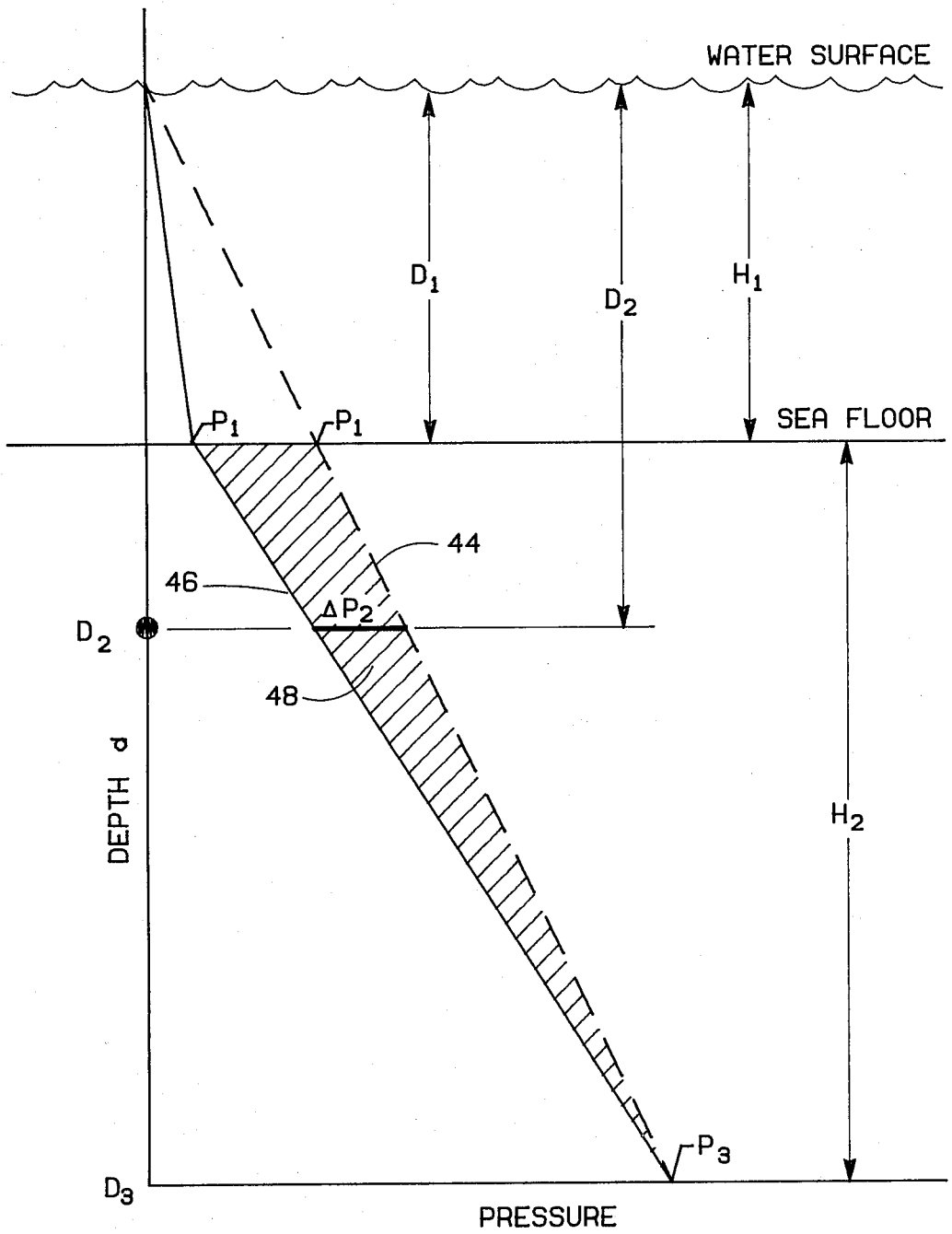
FIG. 2 is a pressure gradient chart illustrating pressure at various depths with and without the present invention.

Attention is next directed to FIG. 2 which illustrates pressure gradients for the drilling mud in the borehole of the drilling mud at various depths. Shown thereon is a chart having depth versus pressure. The chart shows the water depth as $D_1$. By using known technology in a given area for a depth $D_3$ can be determined that the drilling mud should exert a pressure $P_3$ on the formation in order to give proper control in accordance with good drilling practices. This would require a certain mud weight. If the riser pipe is filled with this mud, the pressure obtained with depth is indicated by line 44, which is much higher than the pressure indicated by line 46 which is obtained if we use a low-density fluid in the riser pipe. This is true for all points except at the surface and at depth $D_3$. At the sea floor, the pressure in the conventional system is about twice what it is in our system. At depth $D_2$, there is a $\Delta P_2$ which is still substantial. The difference in pressure is illustrated by the shaded area 48. if the pressure $P_3$, which is required at $D_3$, is obtained, then the pressure at a point $D_2$, as illustrated on line 44, might be sufficient to fracture the formation at depth $D_2$. This, of course, could be hazardous. One way of combating this would be to set casing. However, this cannot always be done and frequently cannot be done economically. This becomes more and more true as the water depth $D_1$ becomes greater and greater. As can be seen then with my system and the pump operational, I maintain a pressure gradient curve 46 which is much less than that of curve 44, yet at depth $D_3$ we can obtain the required pressure $P_3$. In order to obtain the required pressure $P_3$, a slightly heavier drilling mud may be needed for the drilling fluid in order to obtain the pressure $P_3$ because there is a head $H_2$ of drilling mud and $H_1$ of sea water instead of having heads $H_2$ and $H_1$ each of the drilling mud.

While the above description has been made in detail, it is possible to make variations therein without departing from the spirit or scope of the invention.

What is claimed is:

1. A method of drilling a subsea well from a vessel floating on a body of water in which a drilling fluid is circulated down a drill pipe through a drill bit and returned up the annulus between a drill string and the borehole wall, the improvement which comprises:

providing a riser pipe from said wellhead to said vessel, maintaining a lightweight fluid in said riser on top of the drilling fluid in said annulus, said lightweight fluid having a density less than said drilling fluid maintaining a selected pressure on said lightweight fluid by use of pressure generating means; and connecting the annulus below said lightweight fluid to a return conduit extending to said vessel.

2. A method as defined in claim 1 including the step of providing a pump in said return conduit.

3. A method as defined in claim 2 including providing an interface detector between said drilling fluid and said lightweight fluid and controlling the pumping of drilling fluid to the vessel external of said riser in response to the output of said interface detector.

4. A method as defined in claim 3 including providing a plurality of interface sensors at a plurality of elevations along said riser pipe and controlling said pump by a selected one of said interface sensors.

5. A method as defined in claim 3 in which said lightweight fluid is sea water.

6. A method as defined in claim 1 including providing a seal in the upper end of said riser pipe through which said drill string can advance and rotate;

providing a pump in a conduit extending from the lower end of the annular space of said riser pipe and said drill string and the surface of the vessel.

7. A drilling system in which a subsea well is drilled from a floating vessel by circulating a drilling fluid down a drill pipe, the improvement which comprises:

a riser pipe having a slip joint at its upper end and connected at its lower end to said subsea well;

tensioning means supporting the top of said riser pipe in said vessel;

a seal sealing the annular space between said drill pipe and the internal side of said riser pipe below said slip joint;

a return conduit exterior said riser pipe and extending from the interior of the lower end of said riser pipe to said vessel;

a lightweight fluid in said annular space below said seal;

pump means to maintain said lightweight fluid under pressure; and a pump in said return conduit.

8. A system as defined in claim 7 including a level control sensors to determine the interface between said lightweight fluid and said circulating drilling fluid and means to control said pump in said return conduit in response to said detected interface.

9. A system as defined in claim 7 including a plurality of interface sensors at a plurality of elevations along said riser pipe and means for connecting the output of a selected sensor to said pump.

10. A system as defined in claim 7 including means to maintain the upper level of said lightweight fluid at a selected elevation.

11. A method of drilling a subsea well from a vessel floating on a body of water in which a drilling fluid is circulated down a drill pipe through a drill bit and returned up the annulus between the drill string and the borehole wall, the improvement which comprises:

providing a riser pipe from said wellhead to said vessel;

maintaining a lightweight fluid in said riser on top of the drilling fluid in said annulus, said lightweight fluid having a density less than said drilling fluid;

connecting the annulus below said lightweight fluid to a return conduit extending to said vessel;

providing an interface detector between said drilling fluid and said lightweight fluid and controlling the pumping of drilling fluid to the vessel external of said riser in response to the output of said interface detector.

12. A method as defined in claim 11 including providing a plurality of interface sensors at a plurality of elevations along with said riser pipe and controlling said pump by a selected one of said interface sensors.

13. A method as defined in claim 11 in which said lightweight fluid is sea water.

14. A drilling system in which a subsea well drilled from a floating vessel by circulating a drilling fluid down a drill pipe, the improvement which comprises:

a riser pipe having a slip joint at the upper end and connected at its lower end to said subsea well;

tensioning means supporting the top of said riser pipe to said vessel;

a seal sealing the annuluar space between said drill pipe and the internal side of said riser pipe below said slip joint;

a return conduit exterior of said riser pipe and extending from the interior of the lower end of said riser pipe from said vessel;

a lightweight fluid in said annular space below said seal;

a pump in said return conduit;

level control sensors to determine the interface between said lightweight fluid and said circulating drilling fluid; and means to control said pump and said return conduit in response to said detected interface.

15. A system as defined in claim 14, including a plurality of interface sensors at a plurality of elevations along said riser pipe and means for connecting the output of a selected sensor to said pump.

16. A drilling system in which a subsea well is drilled from a floating vessel by circulating a drilling fluid down a drill pipe, the improvement which comprises:

a riser pipe having a slip joint as its upper end and connected at its lower end to said subsea well;

tensioning means supporting the top of said riser pipe to said vessel;

a return conduit exterior said riser pipe and extending from the interior of the lower end of said riser pipe to said vessel;

a lightweight fluid in said annular space above said drilling fluid;

a pump in said return conduit;

means to maintain the upper level of said lightweight fluid at a selected elevation.

17. A method of drilling a subsea well from a vessel floating on a body of water in which a drilling fluid is circulated down a drill pipe to a drill bit and returned up the annulus between a drill string and the borehole wall, the improvement which comprises:

providing a riser pipe from said wellhead to said vessel;

maintaining a lightweight fluid other than air in said riser on top of the drilling fluid in said annulus;

said lightweight fluid having a density less than said drilling fluid; and connecting the annulus below said lightweight fluid to a return conduit extending to said vessel.

18. A method as defined in claim 17 in which said lightweight fluid is sea water.

* * * * *